United States Patent [19]

Torrenteras et al.

[11] 4,364,217

[45] Dec. 21, 1982

[54] DEVICE FOR AUTOMATICALLY OPENING AND FILLING BOXES

[76] Inventors: Angel E. Torrenteras, Avenue du Roi Albert, 176; Antonio E. Torrenteras, Kruipweg, 66, both of Brussels, Belgium

[21] Appl. No.: 130,354

[22] Filed: Mar. 14, 1980

[30] Foreign Application Priority Data

Mar. 16, 1979 [BE] Belgium ..... 194070

[51] Int. Cl.[3] ..... B65B 43/26; B65B 57/00

[52] U.S. Cl. ..... 53/58; 53/564; 493/139; 493/318

[58] Field of Search ..... 493/318, 319, 309, 139, 493/137; 53/566, 564, 458, 457, 58, 55, 501

[56] References Cited

U.S. PATENT DOCUMENTS

| | | | |
|---|---|---|---|
| 1,289,673 | 12/1918 | Cooper | 493/319 |
| 2,662,356 | 12/1953 | Swafford | 53/566 |
| 2,694,350 | 11/1954 | Malhiot | 53/566 X |
| 3,443,357 | 5/1969 | Bacon et al. | 53/566 |
| 3,731,873 | 5/1973 | Brangle, Jr. | 229/41 R |
| 4,040,560 | 8/1977 | Grossman et al. | 229/41 B |
| 4,129,248 | 12/1978 | Casutt | 229/41 B |

*Primary Examiner*—James F. Coan

*Attorney, Agent, or Firm*—Cushman, Darby & Cushman

[57] ABSTRACT

Disclosed is a device for successively conveying flat folded boxes from an aligned stack into an opening station wherein each box is automatically opened and the box bottom is simultaneously folded into position. Also disclosed is a box to be used in said device.

8 Claims, 5 Drawing Figures

DEVICE FOR AUTOMATICALLY OPENING AND FILLING BOXES

This invention has for object a device for conveying one at a time boxes which in folded condition, are of that type the quadrangular bottom of which folds back between the side walls when same are brought together two by two relative to a plane at right angle to the bottom and passing through a diagonal thereof, from a magazine where said boxes are stocked in folded condition, to a station where the boxes are opened while insuring during the transfer, the automatic opening thereof.

The invention has for object to provide a simple, reliable and cheap device to insure the automatic opening of boxes which were opened by hand up to now, said device may advantageously be associated to a system for filling automatically the boxes.

For this purpose according to the invention, said device comprises inside said magazine, means to retain the boxes aligned in a stack in folded condition, in such a way that said boxes bear on one another with the side walls thereof, means to exert on the box stack, a pressure towards the one stack end, and means arranged at said stack end to allow moving one box in folded condition, cross-wise to the stack, said device comprising on the one hand, means to convey a box from the magazine to said station, said latter means bearing on the box side walls of that box lying at said stack end and conveying said box cross-wise to the stack over a distance which is at least equal to the box in folded condition, and on the other hand, in that station where the boxes are opened, means to prevent the movement of the box cross-wise to the stack so as to insure the automatic opening thereof, said latter means lying at a distance as considered in parallel relationship with the box movement and from the magazine which is at the most slightly larger than the length of one diagonal of the box bottom.

The invention has also for an object a box with a quadrangular bottom, particularly a box to be used in said device, the blank of which is so cut-out that the box be foldable to let those elements comprising the bottom fold-back against the side walls inside same, when said side walls are brought together two by two relative to a plane at right angle to the bottom and passing through a diagonal thereof.

According to the invention, those elements comprising the bottom are so cut-out that when the box lies in folded condition, two side walls connected along an edge lying in that plane passing through said diagonal can contact directly one another adjacent said edge.

Other details and features of the invention will stand out from the following description, given by way of non limitative example and with reference to the accompanying drawings, in which.

In the various figures, the same reference numerals pertain to similar elements.

Figure 1:
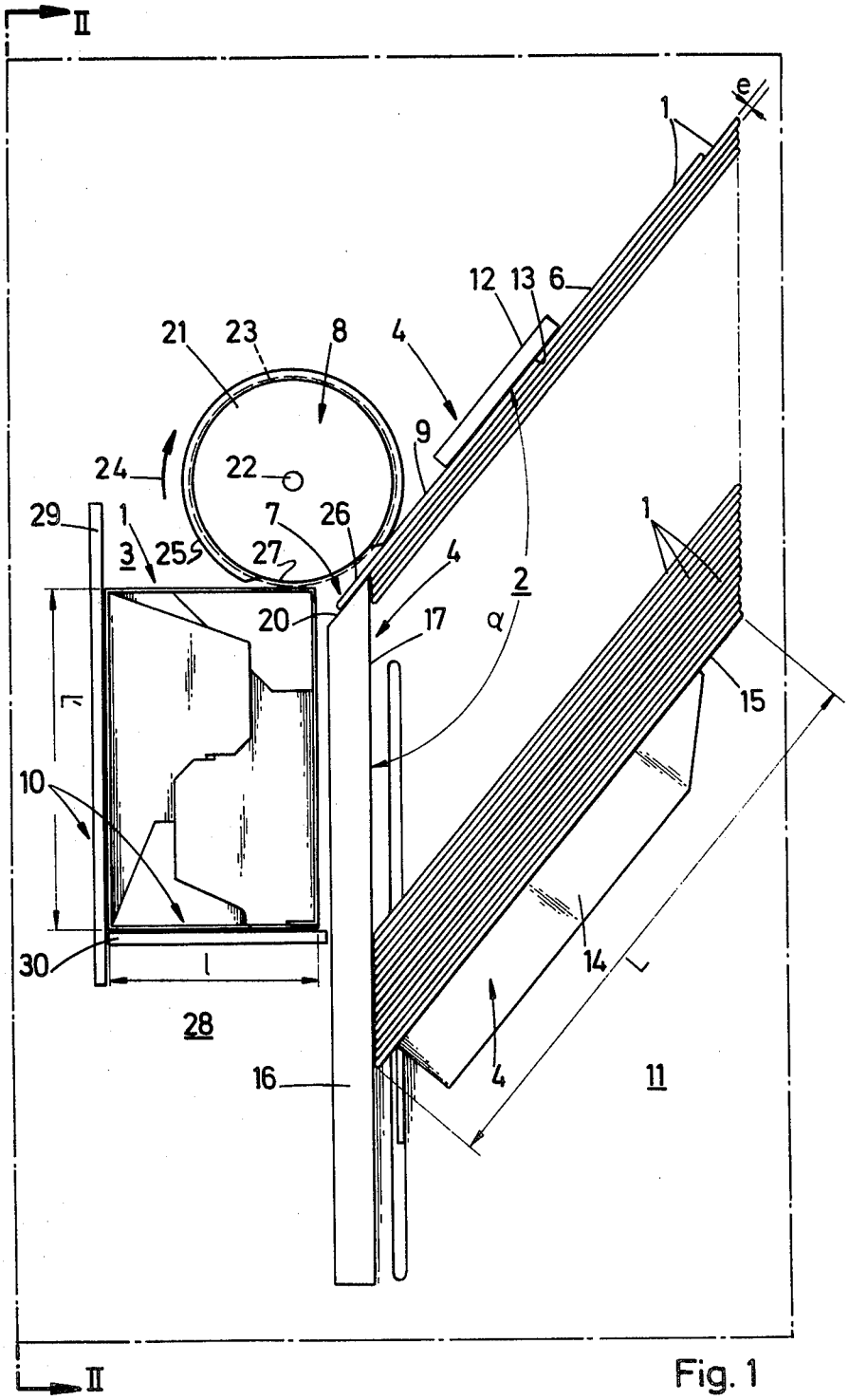
FIG. 1 is a plan view of the device according to the invention.
Figure 2:
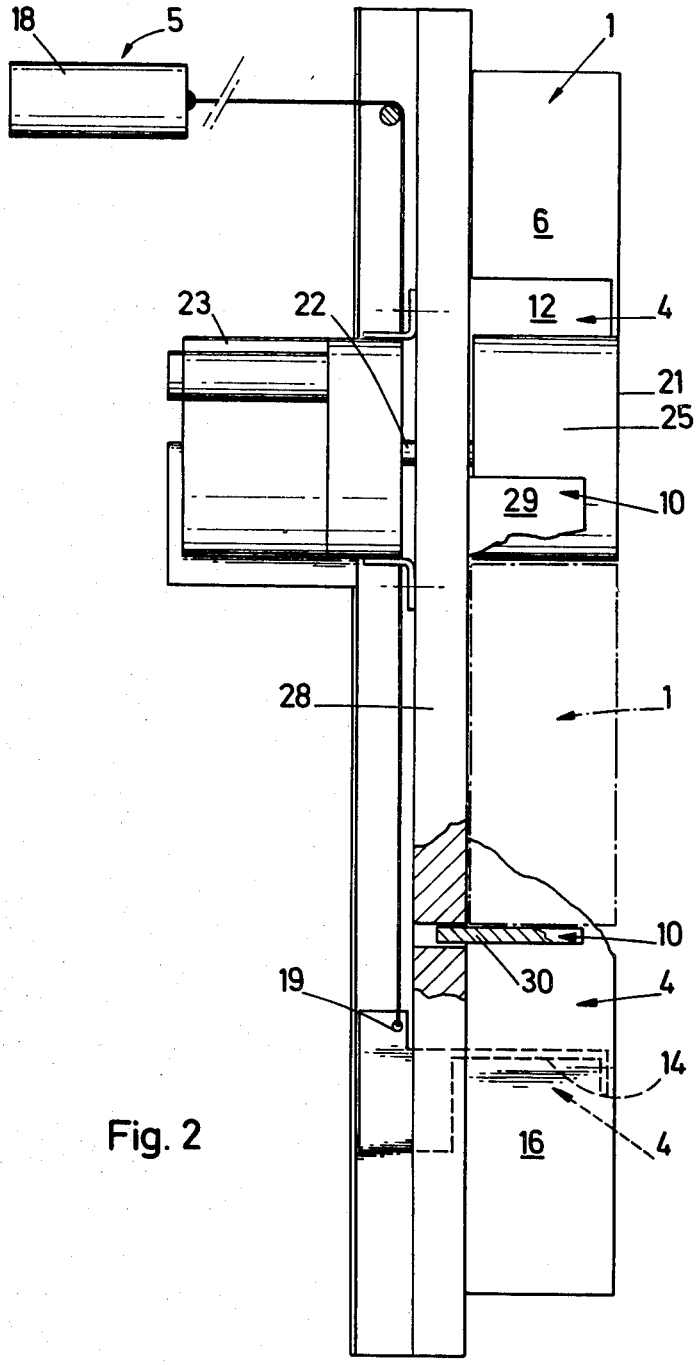
FIG. 2 is a view with parts broken way, along line II—II in FIG. 1.
Figure 3:
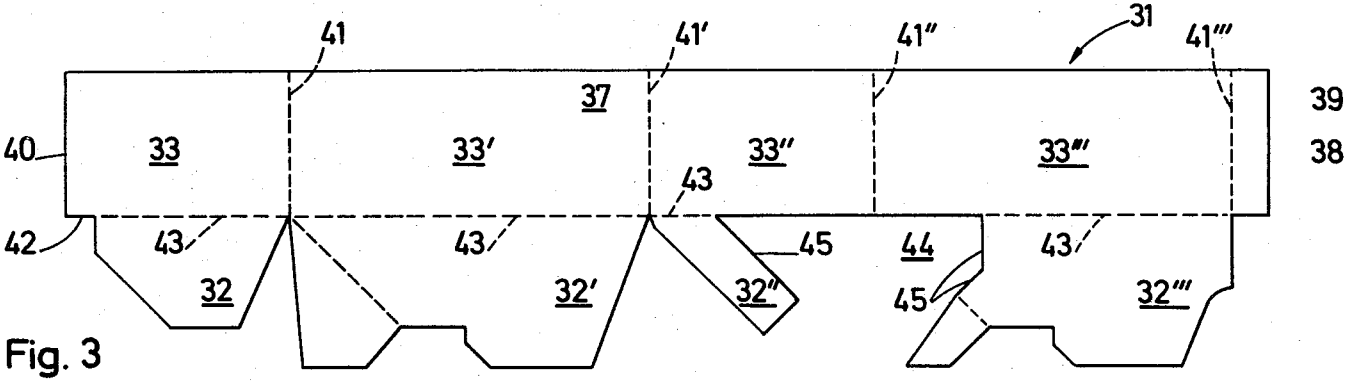
FIG. 3 is a plan view of the blank for the box according to the invention.
Figure 5:
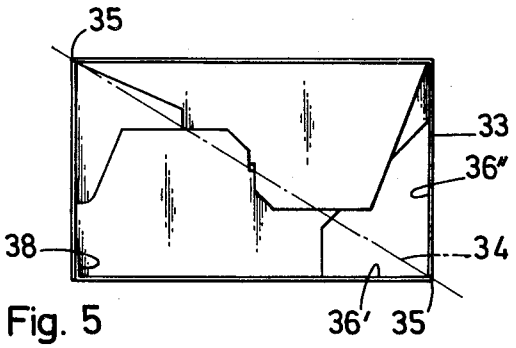
FIG. 5 is a plan view of the box in open condition.
Figure 4:
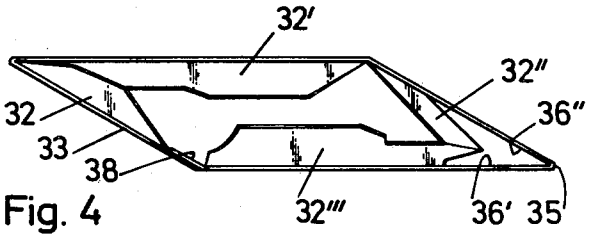
FIG. 4 is a plan view of the box in partly-folded condition.

The device according to the invention as shown in FIGS. 1 and 2, is designed to convey one at a time boxes 1, as shown in FIGS. 3 to 5, from a magazine 2 where the boxes are stocked in folded condition, to a station 3 where said boxes are opened, the automatic opening of the boxes being performed during the conveying thereof. Said device comprises inside magazine 2, means 4 to retain the boxes 1 aligned in a stack in folded condition, in such a way that said boxes bear on one another with the side walls thereof, means 5 being provided to exert on the box stack, a pressure towards the one end 6 of said stack, and means 7 arranged at said stack end 6 to allow the movement of a box in folded condition, cross-wise to said stack, said device further comprising on the one hand, means 8 to convey a box 1 from magazine 2 to station 3, which means are so arranged as to bear on the side walls 9 of that box lying at the end 6 of said stack and to carry said box cross-wise to the stack over a distance at least equal to the length L of the box in folded condition, and on the other hand, in station 3 where the boxes are opened, means 10 to prevent the movement of the box cross-wise to the stack, to insure the automatic opening thereof, said means 10 lying at a distance as considered in parallel relationship with the box movement and from said magazine, which is at the most slightly larger than the length of a diagonal from the box bottom.

In an advantageous embodiment of the invention, said magazine 2 comprises a holder 11 for the boxes 1, said means 4 being comprised of a fixed stop 12 extending at right angle to said holder 11 and against the face 13 of which bears said end 6 of the box stack, a movable element 14 extending in parallel relationship with stop 12 and bearing on end 15 of the box stack, and a fixed guide 16 at right angle to holder 11, extending cross-wise to stop 12 and against the face 17 of which bear the boxes to retain the alignment thereof. The means 5 exerting said pressure are comprised of a counter-weight 18 associated with element 14 in 19, and so arranged as to bias said element in parallel relationship therewith, towards fixed stop 12.

Said means 7 allowing the movement of a box cross-wise to the stack are comprised of the end 20 of guide 16 nearest stop 12, said end 20 lying between said stop 12 and movable element 14 in a plane substantially in parallel relationship with said plane passing through face 13 of stop 12 against which bear the boxes and at a distance from said plane which is at least equal to the thickness e of a box in folded condition. Said conveying means 8 are comprised of the side surface from a straight cylindrical body 21 which is rotatable about a shaft 22 with an axis at right angle to holder 11, said body being so arranged as to bear adjacent a generatrix thereof and substantially facing end 20 of guide 16, on that box lying at stack end 6 and on that box surface which contacts face 13 of stop 12, a motor 23 fastened to holder 11 being provided to rotate said cylindrical body 21 about the axis thereof during the time required to convey a box from magazine 2 to station 3, the cylindrical body rotation direction as shown in FIG. 1 by arrow 24, being such that the box moves from stop 12 to guide 16. According to the invention the circumference of said cylindrical body 21 is advantageously as shown in FIGS. 1 and 2, at least equal to length L of the box in folded condition, in such a way that a revolution of said cylindrical body about the axis thereof causes a box to pass from magazine 2 to station 3, the circuit of motor 23 being so designed as to cut-out energizing thereof when the said cylindrical body has made a complete revolution about the axis thereof. Moreover said cylindrical body 21 has on a portion of the circumference thereof, a projecting layer 25 from anti-skid material the extension of which is substantially equal to said box length L. It will be noticed in FIG. 1, that the circuit of motor 23 is so designed that the cylindrical body will stop in such a way that the portion of said body deprived of anti-skid material will stop in such a way that it lies facing end 20 of guide 16. There is thus obtained for a complete revolution of said body 21, the transfer of a box from magazine 2 to station 3 and part removing of the following box from magazine 2 in such a way that end 26 of said latter box be fed between end 20 of guide 16 and that portion 27 of body 21 deprived of anti-skid material, said box remaining in readiness in this position until that moment where said body 21 will anew be rotated to convey said latter box.

The station 3 comprises a support 28 for the boxes which lies in the extension of holder 11 from magazine 2 and which extends on that side of guide 16 removed from said magazine, said means 10 preventing the movement of the box cross-wise to the stack to insure the automatic opening thereof, being comprised of a first fixed stop 29 which extends in parallel relationship with guide 16 and at a distance therefrom substantially equal to the width 1 of the box bottom in open condition, and a second stop 30 at right angle to stop 29 and extending between said stop 29 and guide 16, said stop 30 lying facing that zone of cylindrical body 21 contacting the boxes and at a distance therefrom which corresponds substantially to length L' of the box bottom in open condition. To insure a good opening of said boxes, guide 16 and stop 29 form with face 13 of stop 12, an angle $\alpha$ which is dependent on the box size and which is equal to or larger than 90° and smaller than 180°. Said stop 30 is advantageously movable to allow releasing the box in said station 3, means (not shown) being provided to retract said stop within holder 28 when it is desired to discharge by hand or mechanically the formed box from said station. To said station 3 can be associated means for automatically filling a box, the means provided to retract said stop 30 then being advantageously controlled from said filling means in such a way that stop 30 is retracted inside support 28 when the box is filled.

The box according to the invention as shown in FIGS. 3 to 5 is a box with rectangular bottom the blank 31 of which is so cut-out as to let the box be folded in such a way that those elements 32, 32', 32'' and 32''' comprising the bottom be foldable over the side walls 33, 33', 33'' and 33''' inside same when the side walls are brought together two by two, that is the walls 33-33' and 33''-33''' relative to a plane at right angle to the bottom and passing through a diagonal 34 thereof (FIG. 5). The elements comprising the bottom are so cut-out that when the box lies in folded condition, both side walls joined along an edge 35 lying in that plane passing through said diagonal can contact one another directly in the zones 36' and 36'' adjacent said edge 35.

The blank 31 the box is formed from comprises a rectangular strip 37 with a constant width, which is to form the box side walls and is comprised of five quadrilaterals 33 to 33''' and 38 bounded by ends 39 and 40 of said strip and by four folding lines 41 to 41''' in parallel relationship with said ends 39 and 40, bounding succeedingly the four side walls of the box. The quadrilateral 38 lying at end 39 is to be folded-back and glued on the quadrilateral 33 lying at the other strip end 40. The blank further comprises four elements 32 to 32'' which are to comprise the box bottom and are cut-out in a way known per se, said elements being distributed along strip edge 42 with folding lines 43 following said edge in such a way as to lie each facing one of the four quadrilaterals which are to form the box side walls, the adjoining elements 32'' and 32''' lying on either side of the folding line 41'' which will form edge 35, having a cut-out 44 bounded in each such elements 32'' and 32''' and from folding line 41'', by strip edge 42 and a segment 45 from a slanting line extending away from the strip, towards the extension of folding line 41'' and ending at such a distance therefrom that the bottom elements 32'' and 32''' will not be pinched between side walls 33'' and 33''' folded back adjacent folding line 41'' corresponding to said edge 35. Said cut-out 44 is provided to let the box bottom free to unfold during the feeding of the box to station 3 of the device according to the invention while said box is still pinched adjacent edge 35 thereof, between end 20 of guide 16 and cylindrical body 21.

It must be understood that the invention is in no way limited to the above embodiments and that many changes can be brought therein without departing from the scope of the invention as defined by the appended claims.

We claim:

1. Device for conveying one at a time boxes in folded condition, said boxes being of the type having a quadrangular bottom which folds-back between side walls thereof when said side walls are brought together two by two relative to a plane at a right angle to the bottom and passing through a diagonal thereof, said boxes being transferred from a magazine wherein said boxes are stacked in folded condition to a station where said boxes are opened, the boxes being automatically opened during transfer thereof, said device comprising means inside the magazine to retain the boxes aligned in a stack in folded condition, in such a way that the side walls of said boxes bear on one another, means to exert a pressure towards one stack end, and means arranged at said stack end to allow the movement of a box in folded condition and cross-wise to the stack, said device comprising on the one hand, means to convey a box from said magazine to said station, said means bearing on the side walls of that box lying at said stack end and driving said box cross-wise to the stack over a distance at least equal to the box length in folded condition, and on the other hand, in the station where the boxes are opened, means to prevent the box being moved cross-wise to the stack, to insure the automatic opening thereof, said latter means being arranged at a distance, as considered in parallel relationship with the box movement from the magazine, which is at the most slightly larger than the length of a diagonal of the box bottom.

2. Device as defined in claim 1, in which said magazine comprises a holder for the boxes, said means to retain the boxes in a stack being comprised of a fixed stop extending at a right angle to the holder and against which bears said end of the box stack, a movable element extending in parallel relationship with the fixed stop, and a fixed guide at a right angle to said holder, extending cross-wise to the fixed stop and against which the boxes bear to retain the alignment thereof, said means to exert said pressure being comprised of at least one counterweight associated with the movable element to bias same in parallel relationship with itself towards the fixed stop, said means to allow moving a box cross-wise to the stack being comprised of the end of said guide nearest the fixed stop, said end lying between said stop and movable element in a plane substantially in parallel relationship with the plane passing through the face of the fixed stop which the boxes bear on and at a distance from said plane at least equal to the thickness of a box in folded condition.

3. Device as defined in claim 2, in which said conveying means are comprised of the side surface of a straight cylindrical body rotatable about a shaft with an axis at right angle to said holder, said body being so arranged as to bear adjacent a generatrix thereof and substantially facing said guide end, on that box lying at the stack end and on that box surface which contacts the fixed stop, a motor being provided to rotate said body about the axis thereof during the time required to convey a box from said magazine to said station, the cylindrical body rotation direction being such that the box moves from the fixed stop to said guide.

4. Device as defined in claim 3, in which the cylindrical body circumference is at least equal to the box length in folded condition in such a way that a revolution of said cylindrical body about the axis thereof will cause a box to pass from said magazine to said station, the circuit of said motor being so designed that the energizing thereof is cut-out when the cylindrical body has completed a revolution about the axis thereof.

5. Device as defined in claim 4, in which the cylindrical body is provided over a portion of the circumference thereof with a layer of anti-skid material, said projecting layer on the body having an extension substantially equal to the length of a box in folded condition.

6. Device as defined in claim 3, in which the station where the boxes are opened comprises a holder for said boxes lying in the extension of the magazine holder and extending on that side of said fixed guide removed from the magazine, said means to prevent the box moving cross-wise to the stack and insuring the automatic opening thereof being comprised of a first stop extending in parallel relationship with said fixed guide and at a distance thereof substantially equal to the one dimension of the box bottom, and a second stop at a right angle to the first stop and extending between said first stop and said guide, said second stop facing that zone of said cylindrical body which engages the boxes and at a distance from said zone corresponding substantially to the other dimension of the box bottom.

7. Device as defined in claim 6, in which at least one of said first and second stops is movable to allow releasing the box from said station, means being provided to retract said movable stop when it is desired to discharge the formed box from said station.

8. Device as defined in claim 7, which further comprises means for filling a box associated with said station, said means to retract said movable stop being controlled from said filling means in such a way that the stop is retracted when the box has been filled.

* * * * *

UNITED STATES PATENT AND TRADEMARK OFFICE

CERTIFICATE OF CORRECTION

PATENT NO. : 4,364,217

DATED : December 21, 1982

INVENTOR(S) : Angel Esteban Torrenteras et al

It is certified that error appears in the above-identified patent and that said Letters Patent is hereby corrected as shown below:

On the title page, the name of the inventors should read

-- Angel Esteban Torrenteras and
Antonio Esteban Torrenteras --.

Signed and Sealed this

*Twenty-first* Day of *June 1983*

[SEAL]

*Attest:*

DONALD J. QUIGG

*Attesting Officer*

*Acting Commissioner of Patents and Trademarks*